US007324320B2

(12) United States Patent
Maurer et al.

(10) Patent No.: US 7,324,320 B2
(45) Date of Patent: Jan. 29, 2008

(54) DEVICE AND A METHOD FOR MAGNETIZING A MAGNET SYSTEM

(75) Inventors: Albert Maurer, Grüt (CH); Urs Meyer, Niederglatt (CH); Stefan Haas, Zürich (CH); Olivier Mueller, Bassersdorf (CH)

(73) Assignee: Albert Maurer, Grüt (CH)

( * ) Notice: Subject to any disclaimer, the term of this patent is extended or adjusted under 35 U.S.C. 154(b) by 190 days.

(21) Appl. No.: 10/933,124

(22) Filed: Sep. 2, 2004

(65) Prior Publication Data

US 2005/0195058 A1 Sep. 8, 2005

(30) Foreign Application Priority Data

Sep. 2, 2003 (CH) ..... 1506/03

(51) Int. Cl.
*H01H 47/00* (2006.01)

(52) U.S. Cl. ..... 361/147

(58) Field of Classification Search ..... 361/147
See application file for complete search history.

(56) References Cited

U.S. PATENT DOCUMENTS

| | | | | |
|---|---|---|---|---|
| 3,678,436 | A * | 7/1972 | Herdrich et al. | 335/284 |
| 4,354,218 | A * | 10/1982 | Steingroever et al. | 361/147 |
| 5,691,873 | A * | 11/1997 | Masaki | 361/166 |
| 5,775,310 | A * | 7/1998 | Ito et al. | 123/644 |
| 6,194,884 | B1 * | 2/2001 | Kesler et al. | 323/285 |
| 6,380,654 | B1 * | 4/2002 | Dokonal et al. | 310/156.53 |
| 6,441,710 | B1 * | 8/2002 | Yanagi et al. | 335/216 |
| 6,542,348 | B1 * | 4/2003 | Stupak, Jr. | 361/147 |
| 6,684,867 | B2 * | 2/2004 | Ito et al. | 123/644 |
| 6,778,087 | B2 * | 8/2004 | Belka et al. | 340/572.3 |
| 2003/0173852 | A1 * | 9/2003 | Biais et al. | 310/156.43 |
| 2004/0021376 | A1 * | 2/2004 | Beulich | 310/52 |

FOREIGN PATENT DOCUMENTS

| | | |
|---|---|---|
| DE | 28 06 000 A1 | 8/1979 |
| DE | 39 34 691 C2 | 3/1993 |
| DE | 100 49 766 A1 | 4/2002 |

* cited by examiner

*Primary Examiner*—Michael Sherry
*Assistant Examiner*—Ann T. Hoang
(74) *Attorney, Agent, or Firm*—Pauley Peterson & Erickson

(57) ABSTRACT

A device for magnetizing a magnet system preferably having several pulse-generator circuits which are mutually arranged so that their magnetic fields superimpose in a cumulative manner. Each pulse-generator circuit includes a capacitor element, a magnetization coil electrically connected to the capacitor element and a switch element by way of which actuation the magnetization coil can be impinged with a current pulse of a limited pulse duration arising by the discharge of the capacitor element, and thus the build-up of a magnetic field may be triggered. The pulse-generator circuit is built up so that the pulse duration of the current pulse is limited to a value between 10 μs and 500 μs. With such short pulse durations, undesirable heating of the magnetization coil is short so that the device may be applied in automatic production installations with cycle times of below 1 s.

30 Claims, 3 Drawing Sheets

DEVICE AND A METHOD FOR MAGNETIZING A MAGNET SYSTEM

BACKGROUND OF THE INVENTION

1. Field of the Invention

This invention relates to a method and a device for magnetizing a magnet system and, for example, is suitable for magnetizing and magnetically anchoring permanent magnets of rare-earth materials on the rotor of an electric motor which may be applied in automatic magnetization installations with low cycle times or with large-scale manufacture.

2. Discussion of Related Art

It is known to use a magnetization coil for magnetizing permanent magnets. The magnetization coil is arranged directly above or around the magnet body to be magnetized. A charged capacitor is allocated to the magnetization coil and the capacitor is discharged via the coil. The magnetic field, which is built up for a brief period in the magnetization coil, magnetizes the magnet body. In order to build up a sufficiently large magnetic field one must use a magnetization coil with many windings or with a large inductance. The usual pulse durations are 10 ms or more. With this, the magnetization coil is heated to an undesirable extent, which renders a high cycle frequency impossible and necessitates the application of expensive cooling systems.

An electrical pulse generator suitable for the operation of magnetization devices according to the known type is disclosed in the German Patent Reference DE-28 060 00. This pulse generator contains a circuit for energy recovery with two capacitors or two simultaneously triggered high-current switches.

Permanent magnets of rare-earth metals such as neodymium-iron-boron (NdFeB) are now taking the place of the ferrite magnets which are applied in large numbers and are considerably more difficult to magnetize because of their high coercive force. Although a magnetic field strength of 800 kA/m is sufficient for the magnetization of conventional magnets of magnet alloys or ferrites, the modern magnets demand 1600-4000 kA/m and have a field strength that lies higher than the saturation degree of all known ferromagnetic materials. An inclusion of iron for the magnetization coil therefore at the most only has an assisting effect, but may no longer effect a field concentration. Air-core coils must be used for magnetization and have a considerably worse efficiency on magnetization because the magnetic field may not be concentrated on the magnets. Thus, considerably higher outputs need to be brought into the coil, and their undesired heating is accordingly higher.

Conventional magnetization installations operate with pulse durations of 10 ms or more. Such pulse durations result in sufficient penetration depths of the magnetic field also in electrically conductive materials where the propagation of magnetic fields is delayed because of eddy currents and also permit the application of inexpensive electrolyte capacitors for storing energy for the magnetization pulse and the application of semiconductor switches for the mains frequency. This technology is suitable for individual magnetizations in the laboratory and in the field of manufacture, but not for large-scale manufacture. In large-scale manufacture there is not sufficient available time for cooling the magnetization coil between the individual magnetization procedures. For modern permanent magnets with a high coercive force the power of such a magnetization installation is limited in large-scale manufacture.

With a restricted space for the magnetization coil, the magnets in the assembled condition may hardly be magnetized with conventional methods. In this case, previously magnetized permanent magnets are installed into the magnet system, which places particular demands on the assembly. The handling of magnetized permanent magnets and magnet systems is awkward because ferromagnetic particles of all types are attracted and may hardly be removed again. The same is the case with the peeling or spalling of the magnet which inevitably results when there is impact of the permanent magnets.

The arrangement for magnetizing magnet systems disclosed in the German Patent Reference DE-100 49 766 makes do without magnetization pulses. According to this reference, a magnetization coil constructed of a coolable high-temperature superconductor is used, which is fed by a direct-current source capable of being closed-loop controlled. This arrangement requires an expensive cooling and consumes much energy. The magnetization coil of a high-temperature superconductor is expensive and is prone to malfunctioning.

German Patent Reference DE-39 34 691 describes a device with which the magnets are inserted into a conductor through which current flows. A magnetization of pre-assembled magnets may not be achieved with this device. The parallelization mentioned in German Patent Reference DE-39 34 691 relates to conductors lying next to one another, for magnetizing long rod magnets or for multi-pole magnetization.

SUMMARY OF THE INVENTION

It is one object of this invention to specify a method and a device for magnetization of permanent magnets which do not have the disadvantages previously mentioned. The method and device of this invention should permit permanent magnets of rare-earth materials to be magnetized in large-scale manufacture with a high cycle rate of one second or less, and thus ensure a high productivity. The method and the device of this invention should be suitable for application in an automatic production installation, and also permit the magnetization of magnets which have been bandaged on rotors, and should operate in an energy-saving manner and operate with air-cooling. The device should be compact, robust, as well as inexpensive and, where possible, employ standard components.

These and other objects are achieved by the method and the device of this invention as specified in this specification and in the claims.

According to this invention, the material to be magnetized is magnetized and magnetically anchored with a current pulse flowing through a magnetization coil or with a magnetic field built up by the magnetization coil. The magnetization by the magnetic field opposes the heating of the magnetization coil. Thus the current pulse should be short enough not to cause a heating which is too high. According to this invention, a current pulse has a pulse duration between 10 μs and 500 μs and preferably between 10 μs and 200 μs. The current pulse should simultaneously be strong enough to build up a magnetic field which is adequate for the magnetization. The short pulse with a strong magnetic field which is thus required is achieved by superposition of several magnetization coils of a low winding number.

Accordingly, with the method according to this invention for magnetizing a magnet system, a magnetization coil is allocated to the magnet system. The magnetization coil is impinged of a current pulse with a limited pulse duration, by which a magnetic field interacting with the magnet system is built up. At the same time, the pulse duration of the current pulse is limited to a value between 10 μs and 500 μs and preferably between 10 μs and 200 μs. In one embodiment, at least two magnetization coils are allocated to the magnet system and are mutually arranged so that their magnetic fields are superimposed in a cumulative manner, and the magnetic fields of the at least two magnetization coils are built up simultaneously.

The device according to this invention, for magnetizing a magnet system, include a pulse-generator circuit with a capacitor element, with a magnetization coil electrically connected to the capacitor element and with a switch element by which actuation the magnetization coil may be impinged with a current pulse of a limited pulse duration which arises by discharging the capacitor element, and thus the build-up of a magnetic field may be triggered. The pulse-generator circuit is constructed so that the pulse duration of the current pulse is limited to a value between 10 μs and 500 μs, preferably between 10 μs and 200 μs. In one embodiment of this invention, the capacitor element includes a solid, flat dielectric provided with a metal layer.

In a preferred embodiment, at least two magnetization coils are present and are mutually arranged so that their magnetic fields superimpose in a cumulative manner, and at least one switch element is arranged and may be actuated so that the at least two magnetization coils may be impinged simultaneously in each case with a current pulse. A switch element can be allocated to each of the at least two magnetization coils, so the device further comprises actuation by which the at least two switch elements may be actuated simultaneously.

In another embodiment of the device according to this invention, the pulse-generator circuit is present in a multiple manner, for example four-fold to twelve-fold, which in the following is indicated as a "parallel multiplication" or "parallelization" of the pulse-generator circuit. With the parallel multiplication, the inductance of the magnetization coil and the capacitance of the capacitor element in the oscillation circuit may be kept small. The demanded short pulse durations of 100 μs, for example, thus result. Despite this, sufficiently large magnetic fields are produced which can magnetize modern, demanding magnet systems.

For a reduction of the heat energy which is released in the magnetization coil, the magnetization pulse is limited in duration. The usual discharge circuit with a recovery diode transfers a considerable share of the impulse energy stored in the capacitor at the exponentially decaying end of the pulse. This section however no longer has any magnetizing effect. With a new type of circuit which has an accumulating inductor coil in the path of the recovery diode, the exponential decay of the current in the magnetization coil can be suppressed and the energy which is contained therein, to a great extent, may be recovered. The inductive return permits the second reoscillation of the capacitor voltage and thus prevents ohmic losses by way of dying-out oscillations. The remaining energy charges the capacitor element again for the next pulse. A reduced energy consumption is thus achieved, and an expensive cooling of the coil is no longer necessary. The second reoscillation via the inductive return, with a fourfold parallelization of the magnetization coil, results in an additional energy saving of 43%. Without parallelization, with a single magnetization coil and the same power, this figure is only 18%.

Accordingly, the pulse-generator circuit preferably comprises a return path which is arranged parallel to the magnetization coil and which contains an accumulating inductor element and a diode element which blocks in the direction of the current pulse. Thus, the accumulating inductor element is dimensioned so that together with the storage capacitor it forms an oscillation circuit whose period duration is larger than the corresponding one of the magnetization circuit.

The electromagnetic oscillation circuit may be assisted by an already magnetized permanent magnet, preferably an NdFeB magnet. This is applied into the magnetization coil so that its field is superimposed with that of the coil and thus acts to intensify.

For magnetizing typical magnet systems, one requires powers which necessitate voltages of 1000 V and more as well as currents in the range of kiloamps. The device according to this invention may be operated with roughly 1000 V, by which the demands on the enamelling (125 V per winding with 8 windings) between individual wire windings in the magnetization coil still lies in regions of no problem. Pulse-resistant capacitors with metallized plastic foils are preferably used as energy storers and have a low intrinsic inductance which influences the properties of the oscillation circuit to a lesser extent. For switching the voltages and currents, for instance bipolar transistors with an insulated gate or rapid thyristors can be used.

BRIEF DESCRIPTION OF THE DRAWINGS

Embodiments of this invention are explained in view of the drawings, wherein.

DESCRIPTION OF PREFERRED EMBODIMENTS

Figure 1:
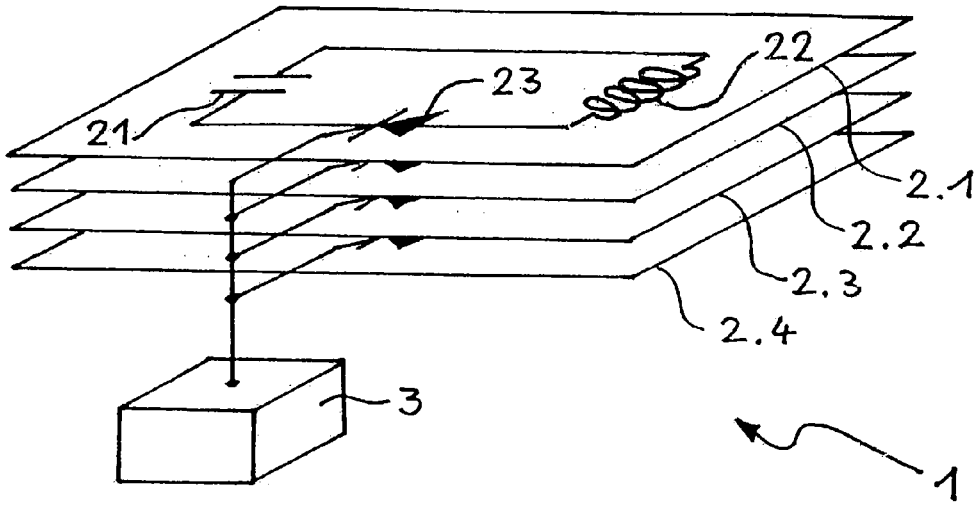
FIG. 1 shows main elements of the device according to this invention, in a schematic perspective view.

Important elements of one embodiment of a device 1 according to this invention are shown schematically in FIG. 1. The device 1 comprises several, preferably identical pulse-generator circuits 2.1-2.4. Four pulse-generator circuits 2.1-2.4 are shown in the embodiment of FIG. 1. There may however be more or less. Each pulse-generator circuit 2.1-2.4 comprises a capacitor element 21, preferably a foil capacitor, and a magnetization coil 22 electrically connected to the capacitor element 21. Each pulse-generator circuit 2.1-2.4 further comprises a switch element 23, for example a thyristor, on whose actuation a pulse-like discharge of the capacitor element 21 via the magnetization coil 22 may be activated, and thus the build-up of a magnetic field in the magnetization coil 22. The device 1 also comprises actuation means or an actuator 3 from which the switch elements 23 of the at least two pulse-generator circuits 2.1-2.4 may be simultaneously actuated. Actuators are known to those skilled in the art. For example, see Werner Lücking, "Thyristor-Grundschaltungen: Handbuch für Ausbildung, Studium und Praxis", (Thyristor basic circuits—handbook for training, education & practice), VDE publishing house, 1984. The pulse-generator circuits 2.1-2.4 and particularly the magnetization coils 22 are mutually arranged so that their magnetic fields superimpose in an cumulative manner. The pulse-generator circuits 2.1-2.4 are shown in more detail in FIG. 2.

Figure 2:
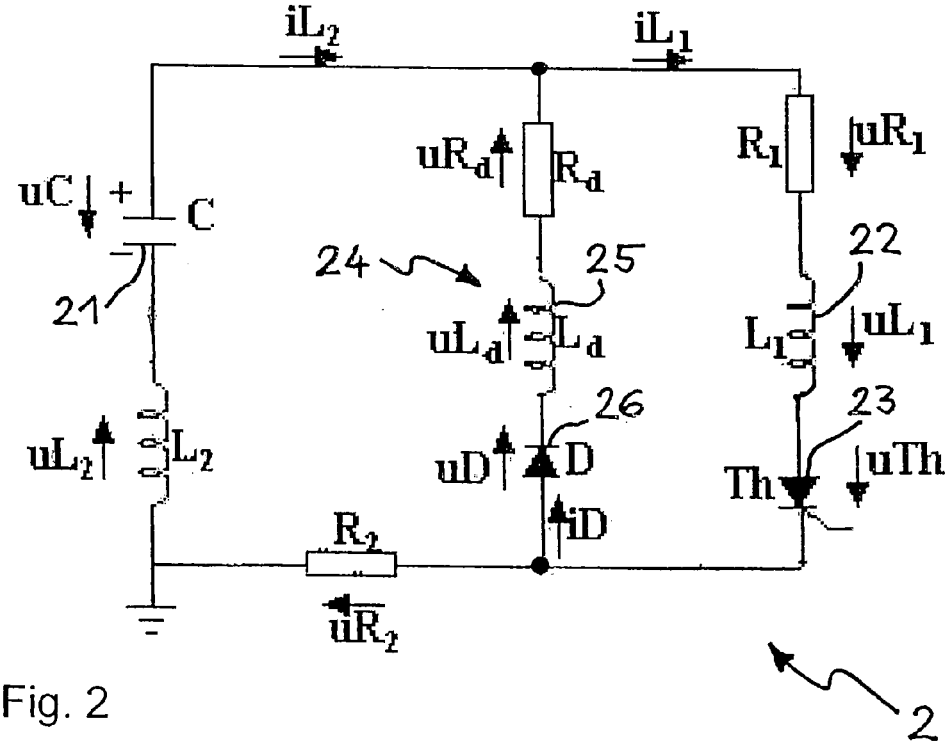
FIG. 2 shows a pulse-generator circuit for a device according to this invention.

FIG. 2 shows one embodiment of a pulse-generator circuit 2 for the device 1 according to this invention. The elements of the capacitor 21 with a capacitance C, magnetization coil 22 with an inductance $L_1$ and thyristor 23 as shown in FIG. 1 may be recognized. The capacitor 21 has an internal inductance $L_2$, the magnetization coil 22 has an internal resistance $R_1$, and the thyristor 23 as well as the electrical leads that connect these elements have an internal resistance $R_2$.

The pulse-generator circuit 2 is designed and dimensioned so that the discharge of the capacitor element 21 has pulse duration of approx. 10-500 μs and preferably approx. 10-200 μs. In order to achieve short pulse durations, the values of C and L must be short, for example 1 μH<L<15 μH as well as 15 μF<C<150 μF, and preferably 2 μH<L<8 μH as well as 30 μF<C<75 μF. In order to achieve adequately high magnetic fields despite the small L and C values, preferably the pulse-generator circuit 2 or parts thereof are multiplied in parallel as shown in FIG. 1. The at least one capacitor element 21 should be chargeable with voltages uC of approx. 100-5000 V and preferably approx. 1200-2000 V. The pulse-generator circuit 2 should permit discharge currents $iL_1$ of approx. 1-10 kA and preferably 2-5 kA.

In the embodiment shown in FIG. 2, a return path 24 is arranged parallel to the magnetization coil 22 and contains an accumulating inductor coil 25 with an inductance $L_d$ and a diode 26 which blocks in the direction of the discharge current pulse. The accumulating inductor coil 25 has an internal resistance $R_d$. With the return path 24 one may suppress the exponential decay of the current in the magnetization coil 22 and to a large extent recover the energy contained therein. The accumulating inductor coil 25 is advantageously dimensioned so that together with the capacitor element 21 it forms an oscillation circuit whose period duration is larger, for example 2 times to 1000 times larger and preferably 10 times to 100 times larger than the corresponding period duration of the magnetization circuit without a return path 24. In order to achieve this, one preferably selects an accumulating inductor coil 25 which has an inductance $L_d$ which is 2 times to 1000 times larger and preferably 10 times to 100 times larger than the inductance $L_1$ of the magnetization coil, e.g. 10 μH<Ld<150 μH.

Figure 3:
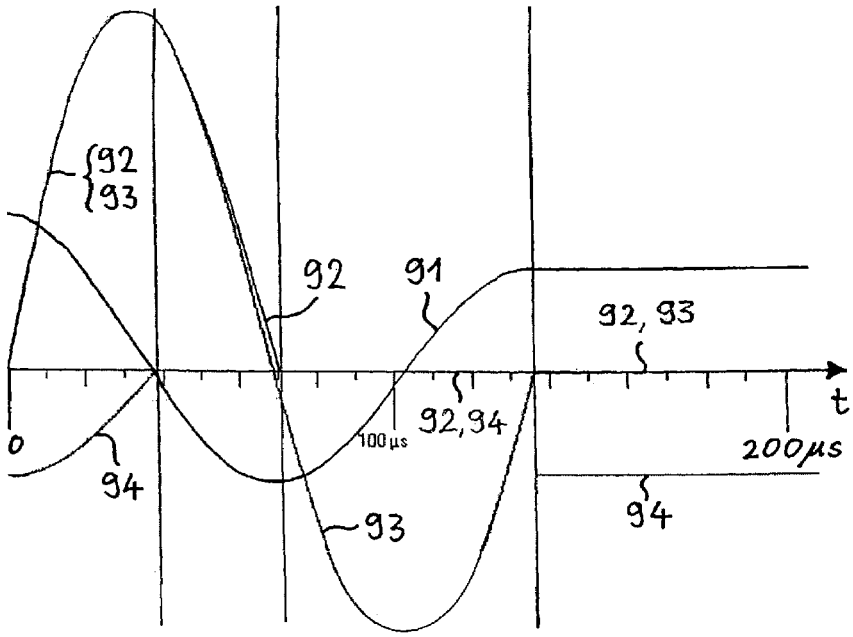
FIG. 3 shows a diagrammatic temporal course of various variables with a method according to this invention.

One embodiment of the method according to this invention is discussed in view of FIG. 3, which relates to the pulse-generator circuit 2 of FIG. 2. The diagram of FIG. 3 shows a computed simulation of the temporal course of various variables, specifically:

| | |
|---|---|
| curve 91: | the charging voltage uCharge = uC − $uL_2$; |
| curve 92: | the magnetization current $iL_1$; |
| curve 93: | the current $iL_2$; and |
| curve 94: | the diode voltage uD. |

For illustration, the various phases of the temporal course are delimited from one another by way of three perpendicular lines.

The simulation is based on the following values:

uC(t=0)=1000 V;

C=60 μF;

$L_2$=2.66 μH;

$L_1$=5.49 μH;

$R_1$=0.062 Ω;

$R_2$=0.01 Ω;

$L_d$=54.9 μH=10 $L_1$; and $R_d$=0.1 Ω.

The following values can result:

maximal coil current $iL_{i,max}$=2348 A;

pulse duration=71 μs;

uCharge(end)=658 V;

energy(t=0)=30 Ws; and energy(end)=43% of the energy(t=0).

Figure 4:
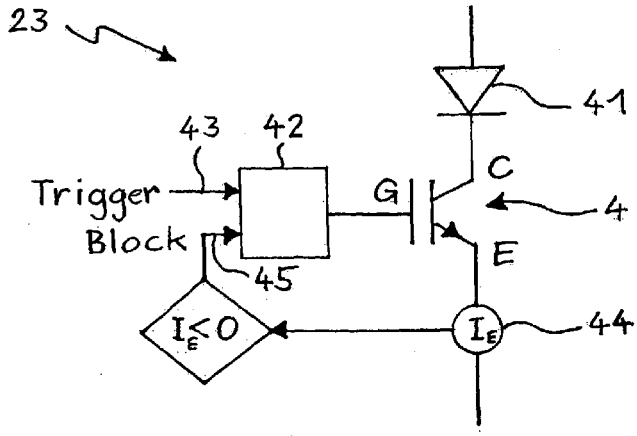
FIG. 4 shows a switch element for a device according to this invention.

The switch element 23 of the device 1 according to this invention instead of the thyristor shown, for example, in FIG. 2 may also contain a bipolar transistor 4 with an insulated gate (insulated-gate bipolar transistor, IGBT). Such a switch element 23 is shown, for example, in FIG. 4. The collector C of the IGBT 4 is electrically connected to the magnetization coil 22. Alternatively, a diode 41 which blocks in the direction opposite to the discharge current pulse may be connected between the magnetization coil and the IGBT. An activation device 42 activates the gate G of the IGBT 4. The activation device 42 comprises a trigger input 43 for a trigger pulse. A current sensor 44 is installed after the emitter E of the IGBT 4, whose signal is fed into the activation device 42 by way of a sensor input 45. If the emitter current $I_E$ is positive and a trigger pulse is present, then the IGBT 4 should accept; otherwise the IGBT 4 should block.

Figure 5:
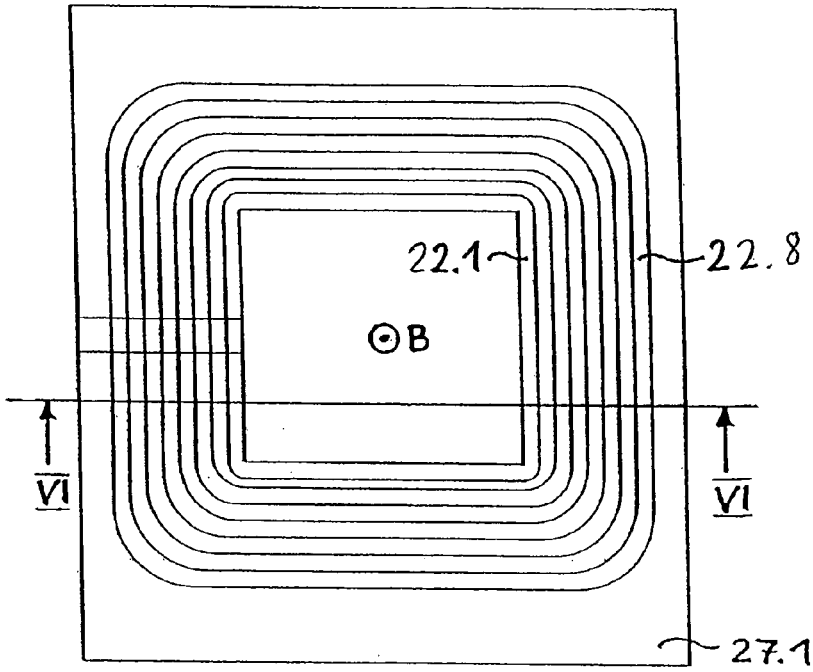
FIG. 5 shows an arrangement of magnetization coils of the device according to this invention, in a plan view.
Figure 6:
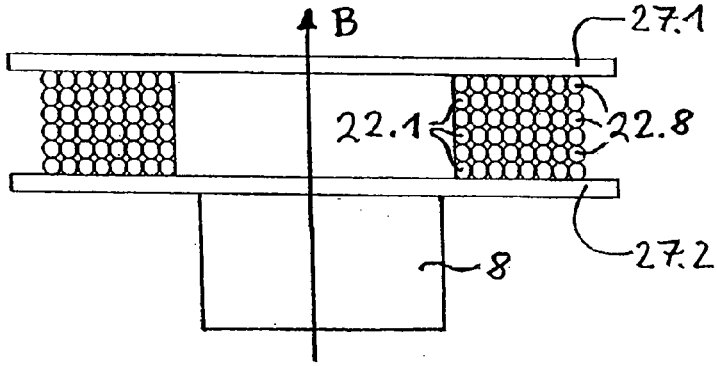
FIG. 6 shows a cross section taken along line VI-VI as shown in FIG. 5.

In FIG. 5, one embodiment of magnetization coils 22.1-22.8 is represented in the device 1 according to this invention, in a plan view. FIG. 6 shows a cross section along the line VI-VI as shown in FIG. 5. In this embodiment, for example eight magnetization coils 22.1-22.8 with different diameters are interdisposed in one another. Each magnetization coil 22.1-22.8 has, for example, six windings. Magnetization coils with bifilament or multifilament windings may be applied. The magnetization coils 22.1-22.8 may be rectangular, square, or round or may have other geometries. The arrangement may be terminated on both sides in each case by way of an epoxy glass plate 27.1, 27.2. The inner and outer diameter of such an arrangement depends on the respective application and typically lies in the ranges of a few to several hundred centimeters. The resulting magnetic field B, such as the superposition of the magnetic fields which are built up in the eight magnetization coils 22.1-22.8 is indicated with an arrow. The arrangement is, for example, positioned on the surface of a magnetic system 8 to be magnetized in a manner such that an as large as possible part of the magnetic field B may interact with the material of the magnetic system 8. If the magnetic system at least partly, is accessible from the sides, the arrangement is then preferably positioned so that the magnetization coils 22.1-22.8 at least partly surround the magnet system. Thus, one may achieve an even more efficient magnetization.

Alternatively, the magnetization coils 22.1-22.8 may also have the same diameter and be arranged above one another. Other combinations of interdispositions and arrangements above one another are also possible. This invention is not limited to the embodiments described above, to which variations and improvements may be made, without departing from the scope of this invention.

Swiss Patent Reference 1506/03, the priority document corresponding to this invention, and its teachings are incorporated, by reference, into this specification.

What is claimed is:

1. A method for magnetizing a magnet system, comprising the steps of:

allocating a magnetization coil to the magnet system;

impinging a magnetization coil with a current pulse of a limited pulse duration to build a magnetic field interactive with the magnet system;

the current pulse being produced by a discharge of a capacitor element which is electrically connected to the magnetization coil, wherein the magnetization coil and the capacitor element are sized and mutually arranged; and leading the current pulse back into a positive terminal of the capacitor element by a return path including an accumulating inductor coil before a recovery diode element arranged parallel to the magnetization coil, wherein a first end of the inductor coil is connected with respect to the positive terminal of the capacitor element, a second end of the inductor coil is connected to a cathode of the recovery diode element, and an anode of the recovery diode element is connected to a ground, whereby an exponential decay of current in the magnetization coil is prevented and electrical energy is recovered in the capacitor to prevent ohmic losses.

2. The method according to claim 1, wherein the pulse duration of the current pulse is limited to the value between 10 μs and 200 μs.

3. The method according to claim 1, wherein at least two magnetization coils are allocated to the magnet system, the at least two magnetization coils are arranged mutually so that magnetic fields of the at least two magnetization coils superimpose in a cumulative manner, and the magnetic fields of the at least two magnetization coils are built up simultaneously.

4. The method according to claim 1, wherein the magnetization coil and the capacitor element are sized and mutually arranged so that the pulse duration of the current pulse is limited to the value between 10 μs and 200 μs.

5. The method according to claim 1, wherein permanent magnets of rare-earth materials are magnetized.

6. The method according to claim 5, wherein the permanent magnets are on a rotor of an electric motor.

7. The method according to claim 1, wherein the pulse duration of the current pulse is limited to the value between 10 μs and 500 μs.

8. A device for magnetizing a magnet system, comprising: a pulse generator circuit with a capacitor element, a magnetization coil electrically connected to the capacitor element and a switch element actuating the magnetization coil in an impingeable manner with a current pulse of a limited pulse duration arising by a discharge of the capacitor element and thus building-up a magnetic field (B) which is triggerable, and the pulse-generator circuit constructed so that the pulse duration of the current pulse is limited to a value between 10 μs and 500 μs, the pulse-generator circuit including a return path arranged parallel to the magnetization coil, a first end of an accumulating inductor element connecting with respect to a positive terminal of the capacitor element and a second end of the accumulating inductor element connecting to a cathode of a recovery diode element, an anode of the recovery diode element connecting to a ground, the recovery diode element blocks in a direction of a discharge current pulse to recover electrical energy in the capacitor and prevent ohmic losses.

9. The device according to claim 8, wherein the pulse-generator circuit is constructed so that the pulse duration of the current pulse is limited to the value between 10 μs and 200 μs.

10. The device according to claim 8, wherein there are at least two magnetization coils mutually arranged so that magnetic fields of the magnetization coils superimpose cumulatively, and at least one switch element is actuatable so that the at least two magnetization coils are simultaneously impingeable with the current pulse.

11. The device according to claim 10, wherein the at least two magnetization coils are interdisposed in each other.

12. The device according to claim 10, further comprising two switch elements, wherein each of the two switch elements is allocated to one of the at least two magnetization coils, and the device further comprises an actuator for simultaneously actuating the two switch elements.

13. The device according to claim 8, further comprising at least two capacitors.

14. The device according to claim 8, wherein the return path is dimensioned so that together with the capacitor element it forms an electrical oscillation circuit having a period duration greater than the period duration of the pulse-generator circuit without the return path.

15. The device according to claim 14, wherein the period duration of the oscillation circuit is 2 times to 1000 times larger than the period duration of the pulse-generator circuit without the return path.

16. The device according to claim 15, wherein the accumulating inductor element is an accumulating inductor coil with an inductance 2 times to 1000 times larger than an inductance of the magnetization coil.

17. The device according to claim 15, wherein the period duration of the oscillation circuit is 10 times to 100 times larger than the period duration of the pulse-generator circuit without the return path.

18. The device according to claim 17, wherein the accumulating inductor element is an accumulating inductor coil with an inductance 10 times to 100 times larger than an inductance of the magnetization coil.

19. The device according to claim 8, wherein the pulse-generator circuit comprises a plurality of accumulating inductor elements connected parallel to one another.

20. The device according to claim 8, wherein the device has at least two pulse-generator circuits.

21. The device according to claim 20, wherein the at least two pulse-generator circuits are identical.

22. The device according to claim 8, wherein the capacitor element comprises a solid, flat dielectric provided with a metal layer.

23. The device according to claim 22, wherein the capacitor element is a foil capacitor.

24. The device according to claim 8, wherein the switch element comprises a bipolar transistor with an insulated gate having a collector electrically connected to the magnetization coil.

25. The device according to claim 24, wherein a gate of the bipolar transistor with the insulated gate is activatable by an activation device which comprises a trigger input for a trigger impulse and a sensor input for a signal of a current sensor measuring an emitter current, and the bipolar transistor with the insulated gate is activatable by the activation device when the current sensor ascertains a negative emitter current.

26. The device according to claim 8, wherein the switch element comprises a thyristor.

27. The device according to claim 8, wherein a pre-magnetized pennanent magnet is arranged in at least one of the magnetization coils so that a magnetic field superimposes in a cumulative maimer with the magnetic field built up by the magnetization coil.

28. The device according to claim 27, wherein the pre-magnetized permanent magnet is an NdFeB magnet.

29. The device according to claim 8, wherein permanent magnets of rare-earth materials are magnetized.

30. The device according to claim 29, wherein permanent magnets on a rotor of an electric motor are magnetized.

* * * * *